United States Patent [19]

Fukayama et al.

[11] Patent Number: 5,037,102

[45] Date of Patent: Aug. 6, 1991

[54] GOLF CLUB HEAD

[75] Inventors: Tadahiro Fukayama, Ogaki; Yasushi Sugioka; Tomomi Soeda, both of Gifu, all of Japan

[73] Assignees: Mizuno Corporation, Osaka; Tokyo Yogyo Company, Tokyo, both of Japan

[21] Appl. No.: 382,055

[22] Filed: Jul. 13, 1989

Related U.S. Application Data

[63] Continuation of Ser. No. 162,712, Mar. 1, 1988, abandoned.

[30] Foreign Application Priority Data

Aug. 24, 1987 [JP] Japan ..... 62-209783

[51] Int. Cl.[5] ..... A63B 53/04

[52] U.S. Cl. ..... 273/167 J; 273/DIG. 23; 273/173

[58] Field of Search ..... 273/167 A, 169, 167 R, 273/167 J, 78, 173, 175, 77 R, DIG. 7, DIG. 23; 428/608; 419/19, 20

[56] References Cited

U.S. PATENT DOCUMENTS

| | | | |
|---|---|---|---|
| 2,908,502 | 10/1959 | Bradstreet et al. | 273/167 J |
| 4,134,759 | 1/1979 | Yajima et al. | 428/608 |
| 4,749,545 | 6/1988 | Begg et al. | 419/19 |
| 4,770,701 | 9/1988 | Henderson et al. | 419/19 |
| 4,793,616 | 12/1988 | Fernandez | 273/167 H |
| 4,793,967 | 12/1988 | Pryor et al. | 419/19 |

FOREIGN PATENT DOCUMENTS

| | | | |
|---|---|---|---|
| 60-66766 | 4/1985 | Japan | 273/DIG. 33 |
| 60-88570 | 5/1985 | Japan | 273/DIG. 33 |
| 1481796 | 8/1977 | United Kingdom | 273/DIG. 32 |

*Primary Examiner*—Edward M. Coven
*Assistant Examiner*—Sebastiano Passaniti
*Attorney, Agent, or Firm*—Wenderoth, Lind & Ponack

[57] ABSTRACT

The present invention provides a golf club head at least the face portion of which is composed of composite materials characterized by aluminum or aluminum alloy either of which are combined with ceramics which are powdery. The golf club head has high strength, high hardness, high elasticity and a good wear resistance, and the face portion of the golf club head of the present invention shows little wear so that the durability of the club head is remarkably high. Moreover, by this invention it is easy to produce a large quantity of golf club heads so that the cost of production is largely diminished and so that a golf club head which is more practical is now available.

3 Claims, 6 Drawing Sheets

FIG. 8

(A) Aℓ POWDER (MEAN POWDER DIAMETER 50 um PURITY 99.7%)

+

(B) $Aℓ_2O_3$ (MEAN GRAIN DIAMETER 20 um) +SiC. (VOLUME RATIO 1:1)

↓

MIXED EQUALLY BY THE AGITATOR

↓

FORM THE FACE PORTION BY THE HOT PRESS (TEMP. 600° PRESSURE 1 TON / $CM^2$)

↓

CASTING (DIE CASTED THE Aℓ-ALLOY MELT TEMP. 700°C, PRESSURE 400kg / $cm^2$)

↓

FORMATION OF FACE PORTION PROPER BY THE COMPLEX COMPOSITION.

FIG. 10

(a) MOLTEN Aℓ-ALLOY (700°C)

+

(b) SiC (MEAN DIAMETER 7um)

↓

AGITATE BY THE AGITATOR OF A FIRE RESISTANT MATERIAL

↓

HEAD AND SOLE PLATE ARE SIMULTANEOUSLY MADE BY THE MOULD.
(MOULDING PRESSURE 800 kg / $cm^2$)

FIG. 11

(A) MELTED Aℓ ALLOY (700°C)

+

(B) SiC

↓

MIX AND AGITATE

↓

FORMATION OF HEAD AND SOLE PLATE BY THE CASTING MACHINE AT THE SAME TIME.

GOLF CLUB HEAD

This application is a continuation of Ser. No. 07/162,712, filed 03/01/88, now abandoned.

BACKGROUND OF THE INVENTION

1. Field of the invention

The present invention relates to an improvement of a golf club head whose face portion is composed of composite materials of aluminum or aluminum alloy either of which are combined with ceramics.

2. Description of the Prior Art

Heretofore, several golf club head materials have been used and such golf club heads are produced by using several methods. For example, it is common that the cutting and processing of wood including persimmon is used and that synthetic resins for example ABS resin, etc., are inserted in the face portion, and that metals, for example aluminum, brass and stainless steel, are used for the sole portion of the club head. Also, golf club heads made from aluminum alloy formed by casting, stainless steel forming and as others, graphite fiber (carbon fiber) reinforced plastics (C-FRP) by compression moulding and whisker strengthened aluminum alloy (FRM) by the squeeze casting are known to the public.

SUMMARY OF THE INVENTION

However, materials of golf club heads heretofore in use have the following defects:

In the case of persimmon, the strength, wear resistance and hardness of the club heads are low and have inferior durability. Also the cost of materials is high and they are not of uniform quality since persimmon is a natural material. Moreover, the wood has high moisture absorption and lacks dimensional stability.

In the case of C-FRP, carbon fiber is considerably expensive and so the total price of the golf club is high. Moreover carbon fiber is liable to peel off from the synthetic resin which forms the matrix causing separation and the wear resistance of the golf club head is inferior, so that carbon fiber has bad durability in practical use.

In the case of stainless steel, the shape of the golf club head has to be made smaller since the specific gravity of stainless steel is high, and a large quantity production of golf club heads is unsuitable because the method of production of a golf club head is of the batch type. Moreover its vibration damping property is inferior and its sound when striking the golf ball is metallic and is not good.

In the case of aluminum alloy, the durability of the golf club head is inferior because the modulus of elasticity and repulsive force are small. Moreover strength, wear resistance and hardness of the golf club head are low.

In the case of FRM, the whisker material is very expensive and aluminum molten metal must be impregnated into the sponge shaped whisker at high pressure in the method of its production. The sponge shaped whisker is broken upon the impregnation with aluminum molten metal and so the whisker is unevenly distributed and badly dispersed. Moreover whisker itself has strong directional properties and in order to control this directional property, extrusion moulding or forging is necessary and so the method of production or shape of the golf club head is greatly limited.

The present invention cures the above-described defects of the golf club head heretofore in use.

It is therefore an object of the present invention to produce a golf club head which has high strength, high hardness, high elasticity and good wear resistance.

Another object of the present invention is to provide a golf club head which is capable of large quantity production.

BRIEF DESCRIPTION OF THE DRAWINGS

FIG. 2 shows good appearance. FIG. 3 shows wear. FIG. 4 shows a break. FIG. 5 is a typical example of the deformation of the golf club head.

FIGS. 8–11 are flow diagrams of the sequential operational steps for preparing a golf club head according to the present invention as described in Examples 1–4, respectively.

DETAILED DESCRIPTION OF THE INVENTION

Figure 1:
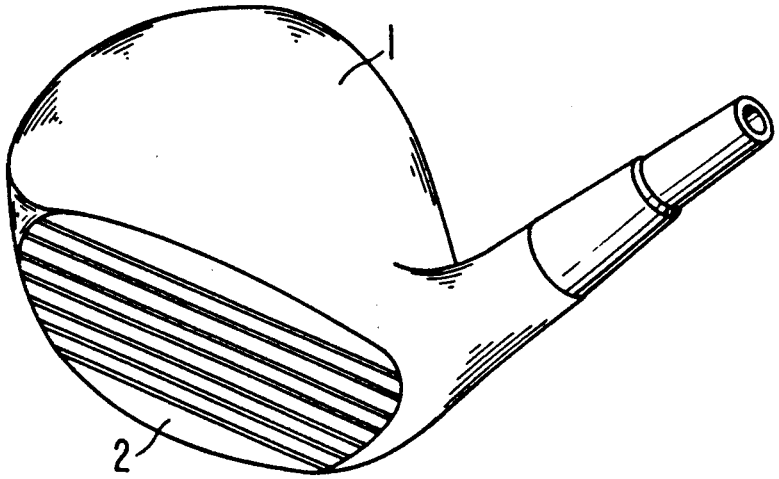
FIG. 1 is a perspective view of one embodiment of the wood type golf club head 1 of the present invention, 2 being the face portion.
Figure 2:
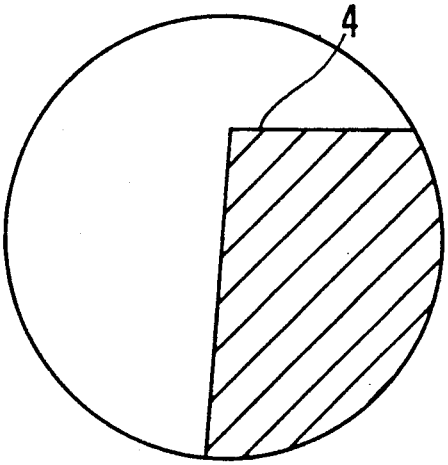
FIGS. 2 to 5 are enlarged sectional views of the present invention which show the appearance of the edge portion 4 of the face lines after a field test.
Figure 3:
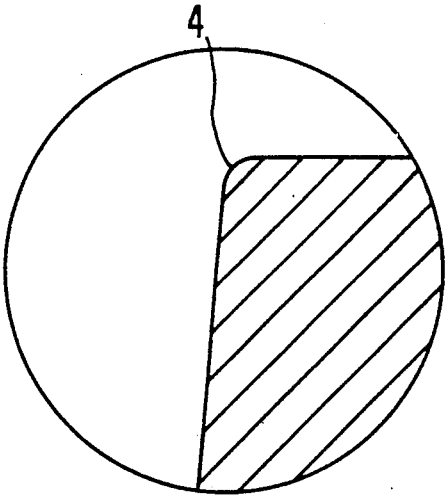
Figure 4:
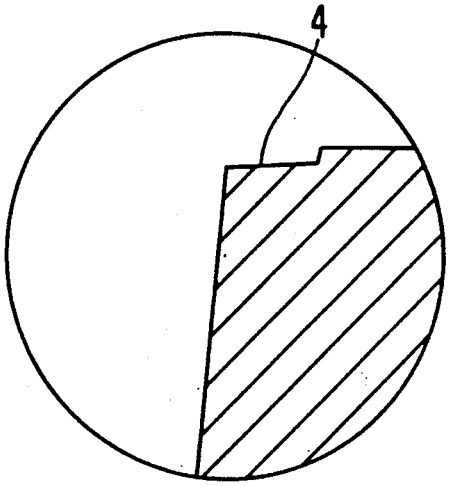
Figure 5:
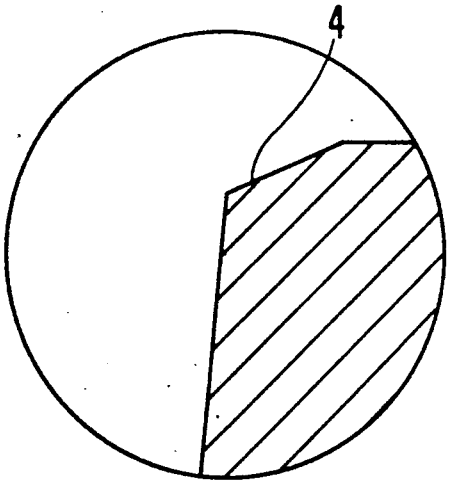

One embodiment of the golf club head of the present invention is shown in the drawings.

Figure 6:
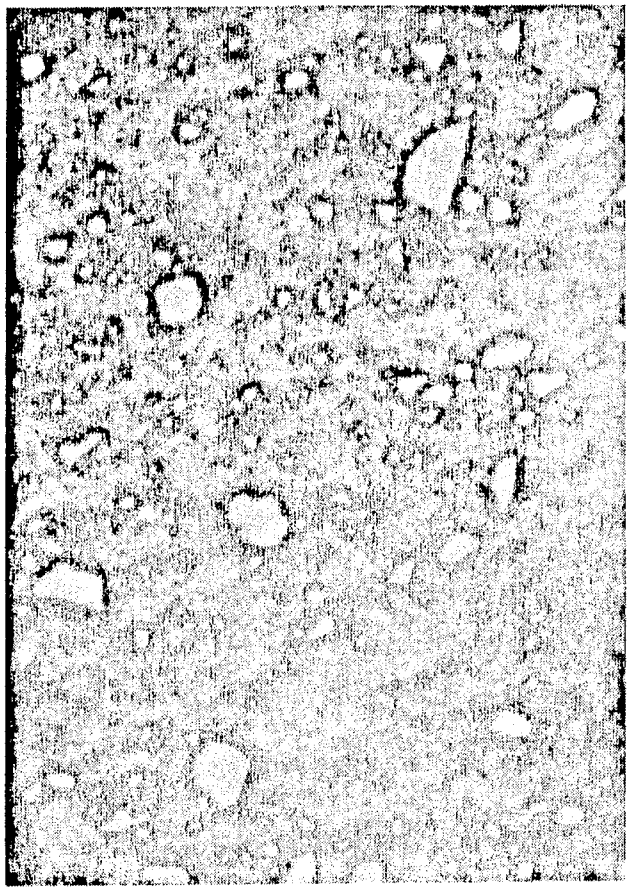
FIG. 6 is a microscopic photograph (×100) of this invention showing the structure of the composite material composed of Al or Al-alloy either of which are combined with ceramics. In the microscopic photograph, the large particles indicate Al or Al-alloy and the small powders between Al or Al-alloy are ceramics combined with Al or Al-alloy.
Figure 7:
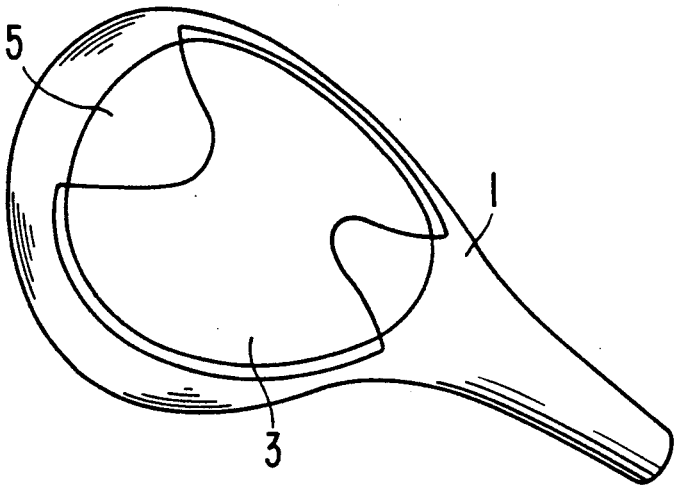
FIG. 7 is a bottom plan view showing the sole plate 3 and bottom surface 5 of an embodiment of the golf club head of the present invention.
Figure 9:
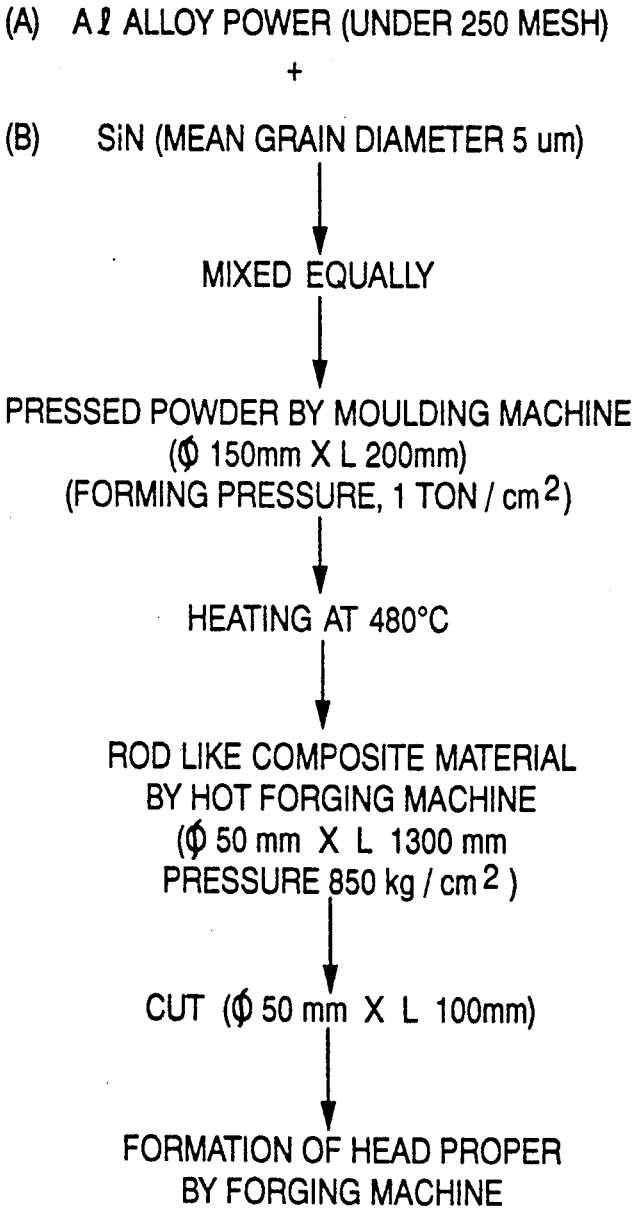

The present invention employs the composite material the constituents of which are aluminum or aluminum alloy either of which are combined with ceramics and said ceramics are powdery. By using composite materials in the face portion 2 of the golf club head as is shown by the photograph of FIG. 6, the problems concerning the materials of golf club heads heretofore in use can be solved.

This is due to the fact that the composite material of the present invention is composed of high strength, high hardness ceramics added to the aluminum or aluminum alloy and is characterized by the fact that the elasticity, strength, wear resistance and hardness of the golf club head is raised greatly, while the specific gravity is similar to aluminum or aluminum alloy.

EXAMPLE 1

Aluminum Powder of mean grain diameter 50 μm (purity 99.7%): Alumina of mean diameter 20 μm and whisker of silicon carbide of mean diameter 0.5 μm and mean length 70 μm=1:1 (volume ratio) is blended uniformly at the rate shown in Table 1, and after blending a face portion only is formed at a temperature of 600° C. and a pressure of 1 ton/cm$^2$.

The above formed face portion is inserted to the mold by using a die casting machine, and then molten aluminum alloy is die casted by insert casting to thus form a golf club head itself which face portion is made from composite materials by casting with molten aluminum alloy, and the temperature of the molten metal is 700° C. and the pressure is 400 Kg/cm$^2$.

EXAMPLE 2

Aluminum Alloy, less than 250 mesh powder (A7075): mean diameter 5 μm silicon nitride and 20 mm length pitch system graphite fiber=9:1 (volume ratio) is blended uniformly at the rate shown in Table 1, and after blending there is obtained a 150 mmϕ×length 200 mm green compact by moulding and its moulding pressure is 1 ton/cm$^2$. Said green compact is then heated at 480° C. and a 50 mmϕ×length 1,300 mm stick formed of composite materials is obtained by hot extruder. Its pressure 850 Kg/cm$^2$.

Said stick formed composite material is cut to a size of 50 mmϕ×length 100 mm and is formed into a golf club head itself by a hot forging machine.

EXAMPLE 3

Silicon carbide having a mean grain diameter of 7 μm is added to 700° C. molten aluminum alloy at the rate shown in Table 1.

After these are agitated throughly by an agitator made from a fireproof material, a golf club head itself and a sole plate are formed at the same time by using a die casting machine. Its compacting pressure is 800 Kg/cm$^2$.

EXAMPLE 4

Silicon carbide having the mean grain diameter as is indicated in Table 1 is added to molten aluminum alloy at a temperature of 700° C. and a golf club head itself and a sole plate are formed at the same time by the same method as

EXAMPLE 3

Blank Test

The inventors made Blank Tests employing the following club heads:

1. Head made from Aluminum Alloy (ADC12) only.
2. Head made from persimmon using ABS resin on the face portion.
3. Head made from C-FRP.
4. Head made from stainless steel.

The weight of the head, loft angle, lie angle and the number of face lines and sectional form are unified with each other and the shafts are provided with the same weight and same hardness.

The following tests were carried out with the samples of Examples 1–4 and the Blank Tests.

Test No. 1 (Wear Test)

The wear test was made by using a 3 mm×20 mm×40 mm plate which was cut off from the face portion, the specific wear quantity was obtained and the results are shown in Table 2.

The wear test was made with the Ogoshi type tester. Testing conditions were as follows:

Turntable SKH3 ($H_RC60$) was used; wear distance 100 m, weight 6.3 Kg, wear speed 3.5 m/sec.

TABLE 1

| Test No. | Blending Ratio (Volume Ratio (%) Metals | Ceramics |
|---|---|---|
| Example 1 | Al Powder | $Al_2O_3$ Particle/SiC Whisker = 1/1 |
| 1 | 99.5 | 0.5 |
| 2 | 99 | 1 |

TABLE 1-continued

| Test No. | Blending Ratio (Volume Ratio (%) Metals | Ceramics |
|---|---|---|
| 3 | 70 | 30 |
| 4 | 50 | 50 |
| 5 | 45 | 55 |
| Example 2 | Al Alloy Powder | $Si_3N_4$ Particle/CF = 9/1 |
| 6 | 99.5 | 0.5 |
| 7 | 99 | 1 |
| 8 | 70 | 30 |
| 9 | 60 | 40 |
| 10 | 50 | 50 |
| Example 3 | Molten Al Alloy | SiC Particle |
| 11 | 99.5 | 0.5 |
| 12 | 99 | 1 |
| 13 | 70 | 30 |
| 14 | 60 | 40 |
| 15 | 50 | 50 |
| Example 4 | Molten Al Alloy | SiC Particle |
| 16 | 80 | 20 mean grain diameter 0.01 μm |
| 17 | 80 | 20 mean grain diameter 0.5 μm |
| 18 | 80 | 20 mean grain diameter 5 μm |
| 19 | 80 | 20 mean grain diameter 65 μm |
| 20 | 80 | 20 mean grain diameter 500 μm |
| 21 | 80 | 20 mean grain diameter 580 μm |
| Blank Test | Materials | |
| 101 | Aluminum Alloy (ADC12) | |
| 102 | Persimmon (it is used with ABS as face portion) | |
| 103 | C-FRD | |
| 104 | Stainless Steel | |

Note:
CF is a graphite fiber

TABLE 2

(Results of Wear Test)

| Test No. | Specific Wear ($\times 10^{-7}$mm$^2$/Kg) |
|---|---|
| 1 | 18 |
| 2 | 9 |
| 3 | 5 |
| 4 | 2 |
| 5 | 0.5 |
| 6 | 21 |
| 7 | 9 |
| 8 | 6 |
| 9 | 2 |
| 10 | 0.8 |
| 11 | 18 |
| 12 | 7 |
| 13 | 4 |
| 14 | 2 |
| 15 | 0.4 |
| 16 | 3 |
| 17 | 3 |
| 18 | 5 |
| 19 | 7 |
| 20 | 9 |
| 21 | 9 |
| Blank Test | |
| 101 | 60 |
| 102 | 528 |
| 103 | 10 |
| 104 | 32 |

Test No. 2 (Field Test)

Field tests were conducted by a striking of the ball 2,000 times. The distance of travel of the ball, shot sound and the surface condition of the face portion of the club after the test were investigated and the results are shown in Table 3.

In the present invention, it is possible that the face insert be made from composite materials composed of ceramics made separately and fixed to the golf club head itself. Moreover, not only the face portion but also the boundary line of the face portion to the sole portion is continuously formed or the face portion and the sole portion are formed with one material (no drawing) and consequently wear, break and gap of the boundary layer are prevented.

It is possible to use as the ceramics material $B_4C$, BN, $ZrO_2$, TiC, WC, $SiO_2$, MgO, $TiO_2$, $Y_2O_3$, $Cr_2O_3$, $CrC_2$, AlN, TiN, $ZrB_2$, $TiB_2$, Sialon, etc. or a mixture of over two of these compounds including ceramics material used in Example 1–4.

Mean grain diameters of these ceramics are 0.01 μm to 500 μm and it is unsuitable to the present invention to use ceramics whose mean grain diameters are less than 0.01 μm or over 500 μm. Wear resistance, hardness and elastic property are inferior in both cases.

According to the present invention, in golf club heads whose face portions are at least composed of the composite materials, the wear resistance of the face portion became higher. This is because high strength and high hardness ceramics are added as a strengthening material, and therefore it is recognized that wear of the edge of the face line does not occur and the amount of back spin is always constant in the field tests. Also the undesirable metallic shot sound which is a defect of the so-called metal wood is not heard. The natural shot sound is heard due to the better damping capacity in the interface of aluminum or aluminum alloy either of which are combined with ceramics.

TABLE 3

| | Results of field test | | |
|---|---|---|---|
| TEST NO. | SURFACE APPEARANCE OF FACE PORTION | DISTANCE | SHOT SOUND |
| 1. | WEAR OCCURS | ⊙ | ○ |
| 2. | GOOD | ⊙ | ⊙ |
| 3. | GOOD | ⊙ | ⊙ |
| 4. | GOOD | ⊙ | ⊙ |
| 5. | EDGE PORTION WAS BROKEN | ○ | ⊙ |
| 6. | WEAR OCCURS | ⊙ | ○ |
| 7. | GOOD | ⊙ | ⊙ |
| 8. | GOOD | ⊙ | ⊙ |
| 9. | GOOD | ⊙ | ⊙ |
| 10. | EDGE PORTION WAS BROKEN | ○ | ⊙ |
| 11. | WEAR OCCURS | ⊙ | ○ |
| 12. | GOOD | ⊙ | ⊙ |
| 13. | GOOD | ⊙ | ⊙ |
| 14. | GOOD | ⊙ | ⊙ |
| 15. | EDGE PORTION WAS BROKEN | ○ | ⊙ |
| 16. | GOOD | ⊙ | ○ |
| 17. | GOOD | ⊙ | ⊙ |
| 18. | GOOD | ⊙ | ⊙ |
| 19. | GOOD | ⊙ | ⊙ |
| 20. | GOOD | ⊙ | ⊙ |
| 21. | CRACKS OCCUR | ○ | ⊙ |
| BLANK TEST | | | |
| 101. | WEAR OCCURS | Δ | Δ |

TABLE 3-continued

| | Results of field test | | |
|---|---|---|---|
| TEST NO. | SURFACE APPEARANCE OF FACE PORTION | DISTANCE | SHOT SOUND |
| 102. | CORNERS OF EDGE PORTION WERE DEFORMED | ○ | ○ |
| 103. | WEAR OCCURS | ○ | ○ |
| 104. | WEAR OCCURS | ○ | X |

NOTE:
⊙ ; VERY GOOD. ○; GOOD. Δ; ORDINARY. X; INFERIOR.

Moreover, although the present invention is in the application and improvement of the known art, in the manufacturing processes of a golf club head the following steps are involved, as is illustrated by Example 1 to 3:

(1) hot press→insert casting
(2) extruding→forging
(3) die casting and ordinary powder metallurgy, casting, plastic processing The manufacturing equipment heretofore in use are used in connection with this invention. Also the present invention is suitable for large quantity production. Thus the production costs of the composite materials which heretofore has been highly expensive can be reduced greatly and it is possible to make practical use of these composite materials.

In the present invention, the so-called wood type club head is illustrated, but the present invention is not limited to a wood type club head but is also applicable to the iron type club head or putter type club head.

We claim:

1. A golf head, the striking face of which is composed of a composition which comprises 50 to 99 percent by volume of aluminum alloy and 1 to 50 percent by volume of a ceramic powder having a powder mean diameter of 0.01 to 500 μm, the ceramic material being at least one material selected from the group consisting of SiC, $Si_2N_3$, $Al_2O_3$, $B_4C$, BN, $ZrO_2$, TiC, WC, $SiO_2$, MgO, $TiO_2$, $Y_2O_3$, $Cr_2O_3$, $CrC_2$, Al, TiN, $ZrB_2$, $TiB_2$ and sailon, the composition being formed by adding ceramic powder to molten aluminum alloy and agitating thoroughly with an agitator, and the golf club head and sole plate thereof being formed at the same time by employing a casting machine as a molding machine for compacting pressure.

2. A golf club head according to claim 1 wherein the ceramic is silicon carbide having a powder mean diameter of 7 μm.

3. A golf club head according to claim 1 wherein the ceramic is silicon carbide, the volume of silicon carbide is 20 percent and the volume of aluminum alloy is 80 percent, the silicon carbide is added to the molten aluminum alloy at a temperature of about 700° C., and the golf club head and sole plate thereof are formed at the same time by employing a casting machine as a molding machine for compacting pressure of 800 $Kg/cm^2$.

* * * * *